United States Patent [19]

Berger et al.

[11] Patent Number: 4,582,205

[45] Date of Patent: Apr. 15, 1986

[54] MODULARIZED PEDESTAL-MOUNT CRANE AND METHOD OF DISASSEMBLY

[75] Inventors: Gerald P. Berger; Frank S. Foster, both of Cedar Rapids; Leroy L. Wittman, Marion; Lyle B. Jensen, Cedar Rapids, all of Iowa

[73] Assignee: FMC Corporation, Chicago, Ill.

[21] Appl. No.: 736,391

[22] Filed: Apr. 29, 1985

Related U.S. Application Data

[63] Continuation of Ser. No. 508,974, Jun. 29, 1983, abandoned.

[51] Int. Cl.[4] ..... B66C 23/26

[52] U.S. Cl. ..... 212/175; 212/186

[58] Field of Search ..... 212/175–183, 212/186, 270, 239, 262

[56] References Cited

U.S. PATENT DOCUMENTS

| | | | |
|---|---|---|---|
| 2,348,285 | 5/1944 | Ekbom et al. | 212/186 |
| 2,609,939 | 9/1952 | Davidson et al. | 212/186 |
| 2,688,411 | 9/1954 | Bushong et al. | 212/186 |
| 3,792,781 | 2/1974 | Blase et al. | 212/175 |
| 3,923,163 | 12/1975 | Brewer | 212/175 |
| 4,266,679 | 5/1981 | Juergens | 212/178 |
| 4,421,241 | 12/1983 | Wittman et al. | 212/186 |

*Primary Examiner*—Galen L. Barefoot
*Assistant Examiner*—Stephen P. Avila
*Attorney, Agent, or Firm*—Ronald C. Kamp; Richard B. Megley; W. William Ritt, Jr.

[57] ABSTRACT

A modularized pedestal mount crane having a base frame with a pair of fore and aft extending flanges with a boom pinned to the forward end of the flanges and an engine is mounted on the rearward portion of the flanges. A winch frame, carrying a plurality of winches, is pinned to the flanges and extends over the engine with vertical links connected between the rearward end of the winch frame and the flanges. A gantry is pinned to the winch frame, and cat walks are cantilever from three sides of the base frame, a cab included on one cat walk.

3 Claims, 5 Drawing Figures

MODULARIZED PEDESTAL-MOUNT CRANE AND METHOD OF DISASSEMBLY

This application is a continuation of application Ser. No. 508,974, filed June 29, 1983, now abandoned.

This invention relates to pedestal mount cranes, amd more particularly to cranes commonly referred to as hydraulic off-shore cranes.

The present invention provides a crane utilizing modular components capable of being easily fastened together to facilitate handling, transport, assembly and repair, which attributes are of particular importance when the crane is to be utilized on an off-shore platform. In addition the A-frame gantry can be folded down to lower the overall height of the crane on its pedestal mount. This is especially useful on an off-shore oil platform when a producing well needs to be serviced with a work over rig. In such a situation the gantry of the crane may interfere with the rig and/or the strings of pipe removed from or replaced in the well. The present invention provides a means and method for removing the gantry as an obstruction with relative ease which often obviates the need to dismount the entire crane.

The drawings are briefly described as follows.

Figure 1:
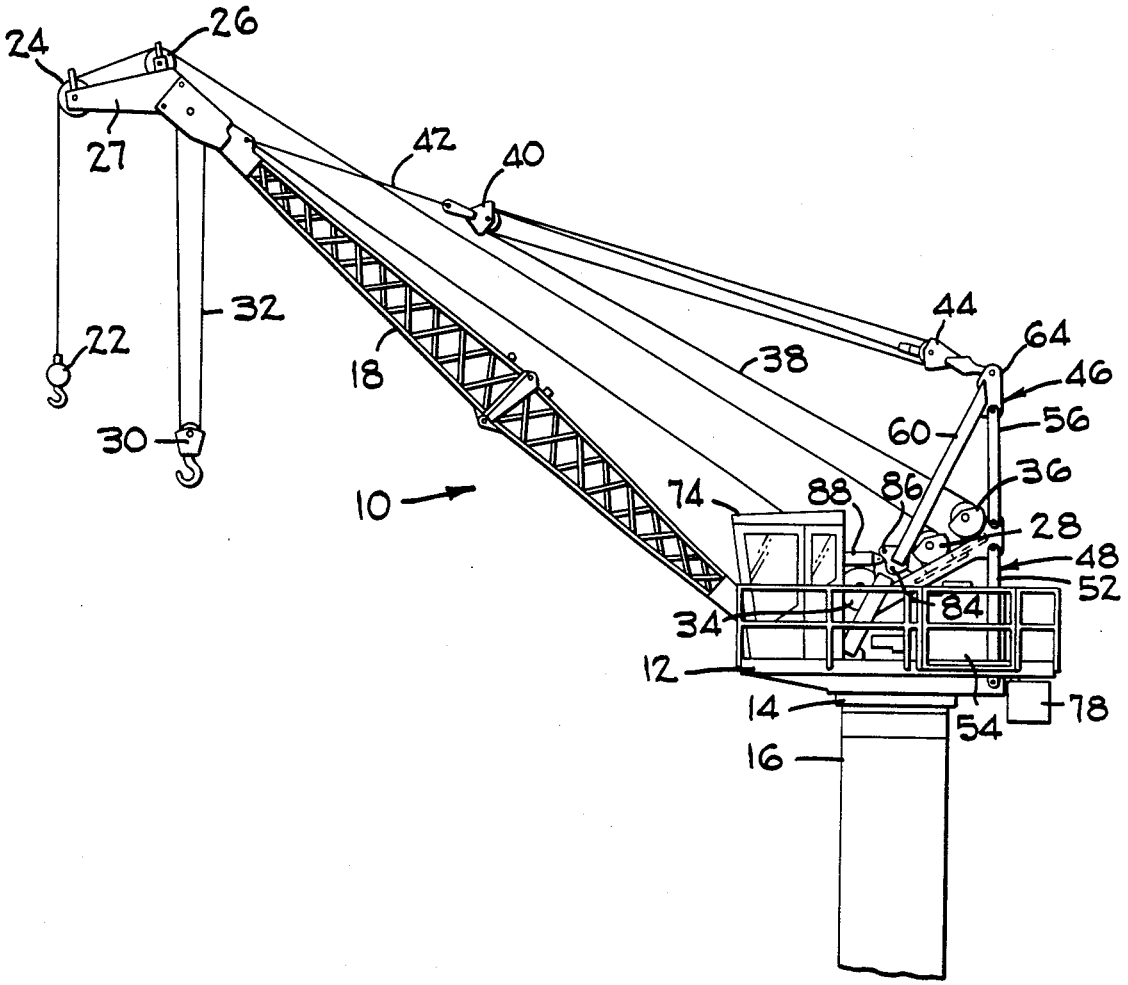
FIG. 1 is a side elevational view of a fully assembled and operational crane according to the present invention.

Referring to FIG. 1, a crane, indicated generally at 10, includes a frame 12 which is rotatably attached to a turntable 14. The turntable 14 is also attached to a pedestal 16 secured to an off-shore platform, for example, and defines a vertical axis for swinging of the crane relative to the pedestal. A boom 18, pivotally mounted on the frame 12, suspends a whip line or rope, which has a hook 22 attached at its free end, is trained over pulleys 24 and 26 on a boom tip extension 27 and is wound on an anxiliary winch 28. A hook block 30 is also suspended from the boom 18 on a wire rope 32 trained over a pulley or pulleys (not shown) on the boom and wound on a main winch 34. The angular position of the boom itself is controlled by a boom hoist winch 36. A wire rope 38 is wound on winch 36 and reeved between a multiple sheave bridle 40, attached to the boom 18 by pendants 42, and a multiple sheave bail 44 pivotally attached to the top of an A-frame gantry 46.

Figure 2:
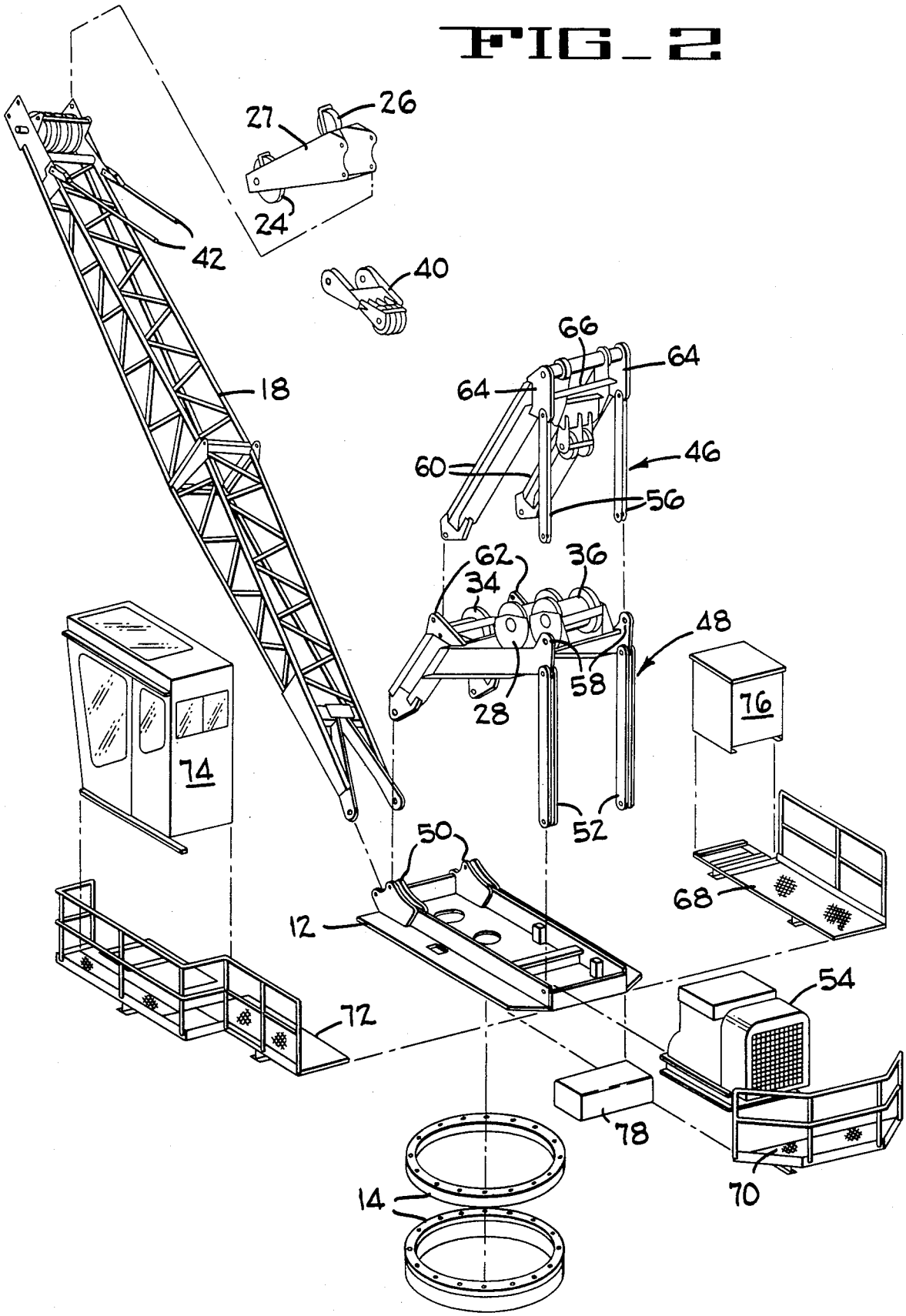
FIG. 2 is an exploded view of the various components for the crane shown in FIG. 1.

The gantry 46 is mounted on top of a winch frame 48, as best seen in FIG. 2. The winches 28, 34, and 36 are mounted on the winch frame 48. The winch frame 48 is pinned to flanges 50 formed on the frame 12 and supported by a pair of vertical links 52 pinned to the frame 12 and to the winch frame 48. An engine 54 is mounted on the frame 12 beneath the winch frame 48 and drives a pump or pumps to supply hydraulic fluid pressure to power the winches and other crane functions. The gantry 46 includes a pair of vertical legs 56, which are pinned to ears 58 formed on the winch frame 48, and a pair of angled legs 60 which are pinned to ears 62 formed on the frame 48. The legs 56 and 60 are pinned together at 64. A cross member 66 is connected between the legs 60. Catwalks 68, 70 and 72 are attached to the right side, rear and left side of the frame 12 respectively to permit access to a cab 74, a hydraulic reservior 76, the winches and the engine. A fuel tank 78 mounted below the rear catwalk 70 may also be accessed from the catwalks. It will be apparent that the crane, as shown in FIG. 2, may be broken down into a plurality of relatively small modular components which can be more easily handled and transported, which facilitate removal for repair and/or replacement and which permit reduction of overall height when necessary.

Figure 3:
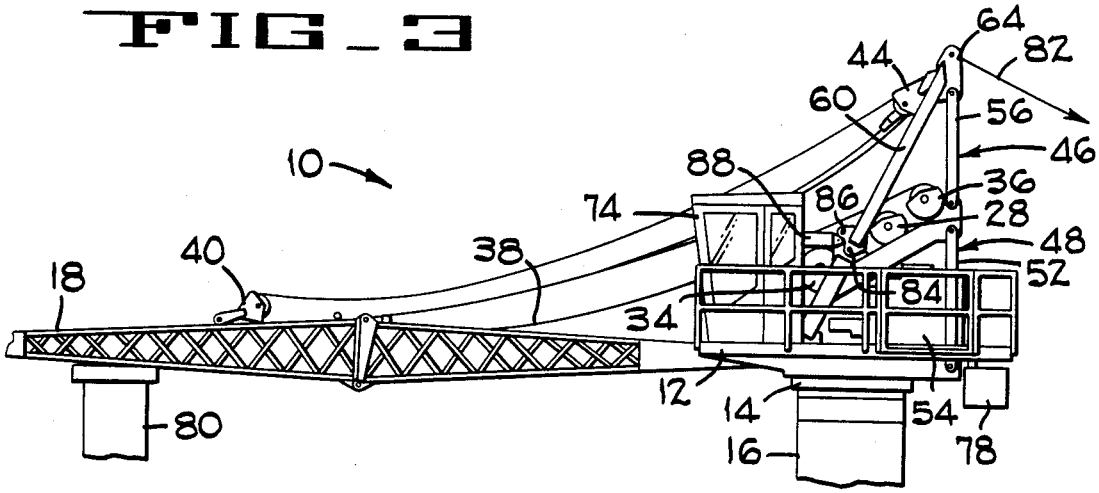
FIG. 3 is a side elevational view of the crane shown in FIG. 1 positioned to begin lowering of the gantry.
Figure 4:
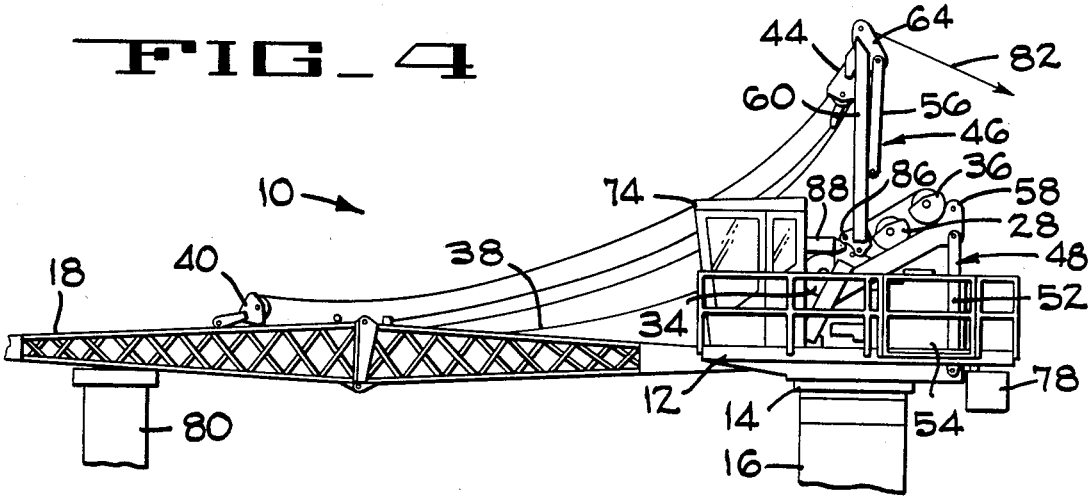
FIG. 4 is a view similar to FIG. 3 but showing an intermediate stage of lowering the gantry.
Figure 5:
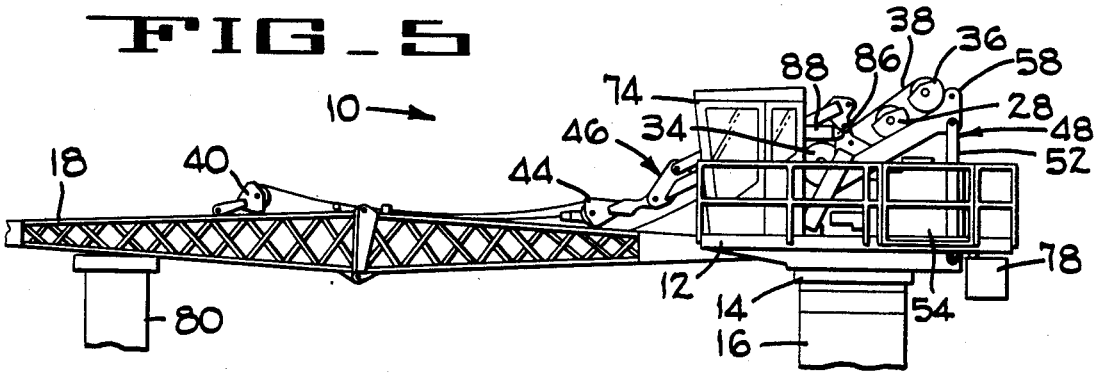
FIG. 5 is a view similar to FIGS. 3 and 4 showing the gantry in its lowered position.

The procedure for lowering the gantry 46 to reduce the crane height is illustrated in FIGS. 3, 4 and 5. The boom is first lowered so that it rests on a support 80 in a substantially horizontal position. The swing lock is set and the boom hoist reeving relaxed. A snubbing line is then applied to the top of the gantry as shown by the arrow 82, which line may be simply a block and tackle, for example, attached between the top of the gantry and a rigid structure on the platform. The pins are then removed to release legs 52 from their connection with the winch frame 48 and the legs 56 secured to the legs 60. The pin 84 connecting the legs 60 to the winch frame 48 are then removed. A folding pin 86 connecting the legs 60 and the frame 48 then becomes a pivot axis for the entire gantry 46. Taking up on the boom hoist winch 36 will supply the force necessary to rotate the gantry forward to the overcenter position as shown in FIG. 4. The snubbing line 82 then lowers the boom 18 until it is in position shown in FIG. 5. The gantry may be erected by reversing the above procedure.

It should be noted that the attachment of the legs 60 as illustrated in FIGS. 1, 3, 4 and 5 is different from that in FIG. 2. The attachment in FIG. 2 of the legs 60 to the frame 62 is by a single pin. When a single pin attachment is utilized, the single pin connecting the legs 60 to the frame 48 is not removed, and functions as the pivot axis for the gantry as it is folded and erected. However, the boom stops 88 will interfere with the gantry and have to be removed. With the use of a second or folding pin 86, the gantry 46 may be folded down without such interference, provided the boom is substantially horizontal at rest on support 80.

While preferred embodiments of the present invention have been shown and described herein, various changes and modifications may be made therein without departing from the spirit of the invention as defined by the scope of the appended claims.

What is claimed is:

1. A pedestal mount crane comprising:

a base frame having a pair of flanges extending along the length thereof with forward and rearward ends;

an engine removably mounted on said base frame between said flanges adjacent said rearward ends;

a boom pinned to said forward ends;

a winch frame having a pair of forward legs formed thereon, said forward legs being pinned to the forward ends of said flanges;

a pair of vertical links, each pinned to the rearward end of one of said flanges and to the winch frame;

a plurality of winches mounted on said winch frame;

a gantry including a U-shaped member and a pair of vertical legs;

said U-shaped member including a pair of angled legs with a cross member interconnected between their upper ends;

first pin means for pinning each of said angled legs to a corresponding one of said forward legs;

said pair of vertical legs being pinned between said U-shaped member adjacent said cross member and said winch frame, each of said vertical legs being substantially aligned with the corresponding one of said vertical links and the length of said vertical legs being such that said end of said forward legs and said angled legs are substantially aligned, and cat walks cantilevered from three sides of said main frame.

2. The invention according to claim 1, and further comprising:

a second pin means for pinning said angled legs to said forward legs at an elevation about said front pin means;

said second pin means functioning as a pivot for rotating said gantry forward when the first pin means are removed and said vertical legs are unpinned from said winch frame.

3. The invention according to claim 2, and further comprising:

a cab having a roof mounted on said cat walk;

said winch frame extending over said engine and having an elevation below the roof of the cab.

* * * * *